US008888530B2

(12) United States Patent
Trout et al.

(10) Patent No.: US 8,888,530 B2
(45) Date of Patent: Nov. 18, 2014

(54) GROUNDING STRUCTURES FOR CONTACT MODULES OF CONNECTOR ASSEMBLIES

(71) Applicant: Tyco Electronics Corporation, Berwyn, PA (US)

(72) Inventors: David Allison Trout, Lancaster, PA (US); Richard Elof Hamner, Hummelstown, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 86 days.

(21) Appl. No.: 13/777,832

(22) Filed: Feb. 26, 2013

(65) Prior Publication Data

US 2014/0242841 A1 Aug. 28, 2014

(51) Int. Cl.
*H01R 13/648* (2006.01)
*H01R 13/6585* (2011.01)

(52) U.S. Cl.
CPC ..... *H01R 13/6585* (2013.01)
USPC ..... 439/607.07

(58) Field of Classification Search
CPC ..... H01R 23/688; H01R 13/514
USPC ..... 439/607.07, 701
See application file for complete search history.

(56) References Cited

U.S. PATENT DOCUMENTS

| | | | | |
|---|---|---|---|---|
| 4,705,332 | A * | 11/1987 | Sadigh-Behzadi | 439/69 |
| 5,702,258 | A * | 12/1997 | Provencher et al. | 439/79 |
| 6,293,827 | B1 * | 9/2001 | Stokoe | 439/607.07 |
| 6,435,914 | B1 | 8/2002 | Billman | |
| 6,645,003 | B2 * | 11/2003 | Yoshida et al. | 439/507 |
| 7,572,154 | B2 * | 8/2009 | Ichio et al. | 439/701 |
| 2009/0042445 | A1 * | 2/2009 | Ichio et al. | 439/626 |
| 2013/0017725 | A1 | 1/2013 | Davis et al. | |

FOREIGN PATENT DOCUMENTS

WO 99/26321 A1 5/1999

OTHER PUBLICATIONS

Extended European Search Report mailed on May 30, 2014, issued in corresponding EP application No. 14156484.9.

* cited by examiner

*Primary Examiner* — Phuongchi T Nguyen

(57) ABSTRACT

A connector assembly includes contact modules each having a wafer, a first ground frame extending along a first side of the wafer and a second ground frame extending along a second side of the wafer. The wafer has a dielectric body holding a plurality of signal contacts. The first ground frame has beams extending from a front of the first ground frame. The second ground frame has shields at least partially surrounding corresponding mating portions of the signal contacts. Each first ground frame is mechanically and electrically connected to an adjacent second ground frame of an adjacent contact module. Each second ground frame is mechanically and electrically connected to an adjacent first ground frame of an adjacent contact module.

19 Claims, 6 Drawing Sheets

GROUNDING STRUCTURES FOR CONTACT MODULES OF CONNECTOR ASSEMBLIES

BACKGROUND OF THE INVENTION

The subject matter herein relates generally to grounding structures for contact modules of connector assemblies.

Some electrical systems, such as network switches and computer servers with switching capability, include board-to-board electrical connectors that are mated to electrically connect two circuit boards together. However, conventional electrical connectors have experienced certain limitations. For example, it is desirable to increase the data rate through the electrical connectors and to increase the density of the signal and ground contacts within the electrical connectors. Increases in data rate and density have led to problems with signal degradation. For example, electrical shielding of the signal paths through conventional electrical connectors has limitations, which have led to signal degradation, particularly at high data rates.

A need remains for an improved connector system that has high contact density and improved signal integrity in differential pair applications.

BRIEF DESCRIPTION OF THE INVENTION

In one embodiment, a connector assembly is provided that includes a front housing and a plurality of contact modules held by the front housing. Each contact module has a wafer having a dielectric body holding a plurality of signal contacts. The dielectric body has a first side and a second side. The signal contacts have mating portions extending forward from a front of the dielectric body. Each contact module has a first ground frame extending along the first side of the dielectric body providing electrical shielding for the signal contacts. The first ground frame has beams extending from a front of the first ground frame. Each contact module has a second ground frame extending along the second side of the dielectric body providing electrical shielding for the signal contacts. The second ground frame has shields at least partially surrounding corresponding mating portions of the signal contacts. Each first ground frame is mechanically and electrically connected to an adjacent second ground frame of an adjacent contact module. Each second ground frame is mechanically and electrically connected to an adjacent first ground frame of an adjacent contact module.

Optionally, the plurality of contact modules may include a first contact module, a second contact module and a third contact module arranged in a stacked configuration adjacent one another in the front housing. The beam of the first ground frame of the second contact module may engage the second ground frame of the first contact module and the second ground frame of the second contact module may engage the beam of the first ground frame of the third contact module.

In another embodiment, a contact module is provided for a connector assembly. The contact module includes a wafer having a dielectric body holding a plurality of signal contacts. The dielectric body has a first side and a second side. The signal contacts have mating portions extending forward from a front of the dielectric body. The contact module includes a first ground frame extending along the first side of the dielectric body. The first ground frame provides electrical shielding for the signal contacts. The first ground frame has beams extending from a front of the first ground frame. The contact module includes a second ground frame extending along the second side of the dielectric body. The second ground frame provides electrical shielding for the signal contacts. The second ground frame has shields at least partially surrounding corresponding mating portions of the signal contacts. The beams of the first ground frame are configured to engage a second ground frame of an adjacent contact module. The second ground frame is configured to engage a first ground frame of an adjacent contact module.

In a further embodiment, a connector assembly is provided having a front housing and first and second contact modules held in the front housing. The includes a wafer holding a plurality of signal contacts, an first ground frame extending along a first side of the wafer and providing electrical shielding for the signal contacts, and an second ground frame extending along a second side of the wafer and providing electrical shielding for the signal contacts. The second ground frame has shields at least partially surrounding corresponding signal contacts and tabs extending therefrom. The first ground frame has beams extending from a front of the first ground frame. The second contact module includes a wafer holding a plurality of signal contacts, a first ground frame extending along a first side of the wafer and providing electrical shielding for the signal contacts, and a second ground frame extending along a second side of the wafer and providing electrical shielding for the signal contacts. The second ground frame has shields at least partially surrounding corresponding signal contacts. The second ground frame has tabs extending therefrom. The first ground frame has beams extending from a front of the first ground frame. The beams of the first ground frame of the first contact module engage corresponding tabs of the second ground frame of the second contact module. The tabs provide a holding force to pull the first contact module toward the second contact module. The first ground frame of the first contact module is electrically commoned with the second ground frame of the second contact module.

DETAILED DESCRIPTION OF THE INVENTION

Figure 1:
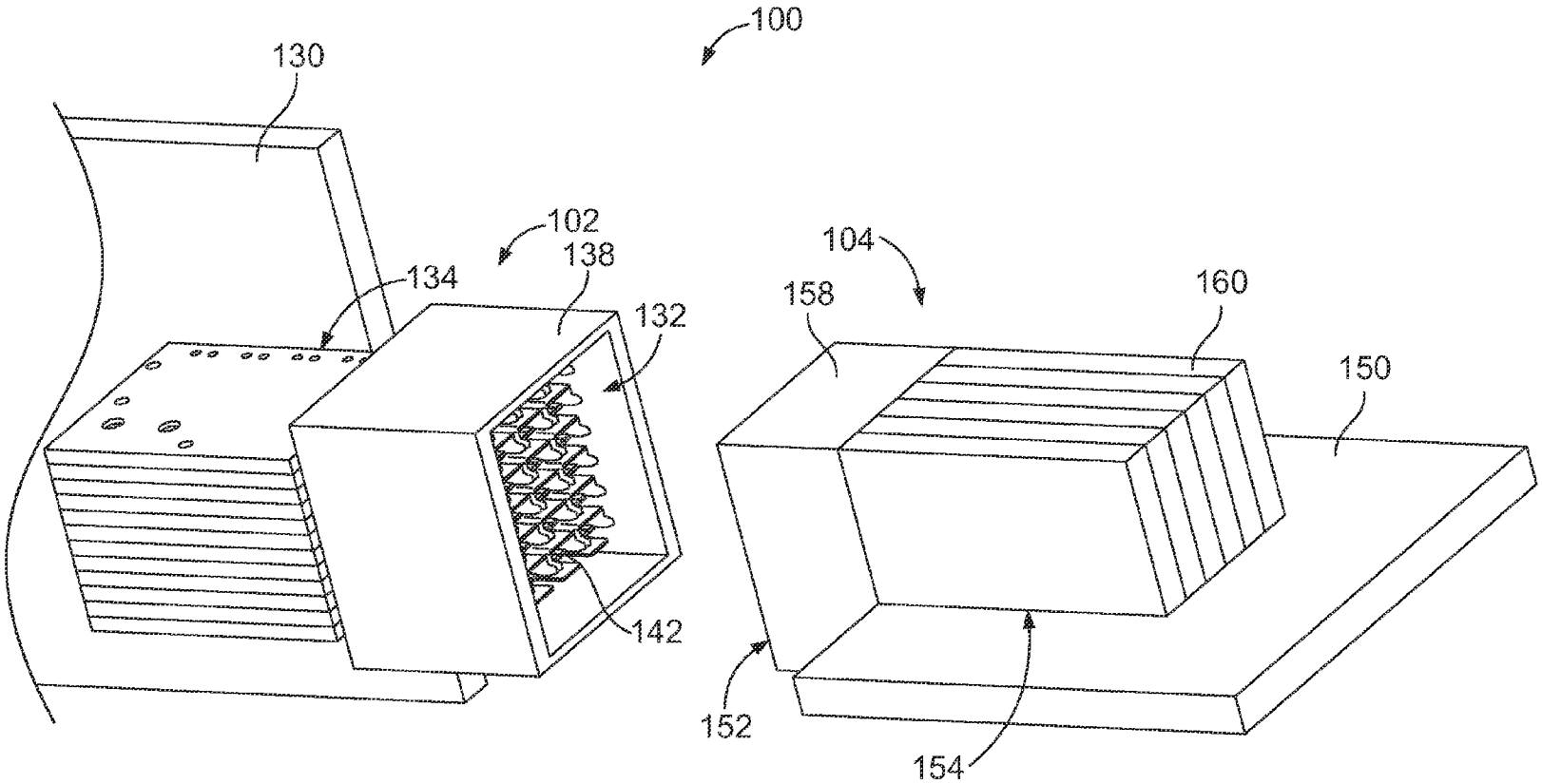
FIG. 1 is a perspective view of an electrical connector system formed in accordance with an exemplary embodiment.

FIG. 1 is a perspective view of an electrical connector system 100 formed in accordance with an exemplary embodiment. The electrical connector system 100 may be a board-to-board connector system configured to interconnect circuit boards. The connector system 100 includes a first connector assembly 102 and a second connector assembly 104. Optionally, the first connector assembly 102 may be part of a daughter card and the second connector assembly 104 may be part of a backplane, or vice versa. The first and second connector assemblies 102, 104 may be line cards or switch cards.

The first connector assembly 102 is mounted to a first circuit board 130 and is configured to be coupled to the second connector assembly 104 at a mating interface 132. The first connector assembly 102 has a board interface 134 configured to be mated with the first circuit board 130. In an exemplary embodiment, the board interface 134 is orientated perpendicular with respect to the mating interface 132; however other orientations are possible in alternative embodiments.

The first connector assembly 102 includes a front housing 138 that holds a plurality of contact modules 140. The contact modules 140 are held in a stacked configuration generally parallel to one another. The contact modules 140 hold a plurality of signal contacts 142 that are electrically connected to the first circuit board 130 and define signal paths through the first connector assembly 102. Optionally, the signal contacts 142 may be arranged in pairs carrying differential signals.

The contact modules 140 provide electrical shielding for the signal contacts 142. In an exemplary embodiment, the contact modules 140 generally provide 360° shielding for each pair of signal contacts 142 along substantially the entire length of the signal contacts 142 between the board interface 134 and the mating interface 132. In an exemplary embodiment, the shielding structure of each contact module 140 that provides the electrical shielding for the pairs of signal contacts 142 is electrically connected to the shielding structure of adjacent contact modules to electrically common each of the contact modules 140. The shielding structures may be electrically connected proximate to the mating interfaces 132.

The second connector assembly 104 is mounted to a second circuit board 150. The second connector assembly 104 is configured to be coupled to the first connector assembly 102 at a mating interface 152. The second connector assembly 104 has a board interface 154 configured to be mated with the second circuit board 150. In an exemplary embodiment, the board interface 154 is orientated perpendicular with respect to the mating interface 152. When the second connector assembly 104 is coupled to the first connector assembly 102, the second circuit board 150 may be orientated perpendicular with respect to the first circuit board 130; however other orientations are possible in alternative embodiments.

The second connector assembly 104 includes a front housing 158 that holds a plurality of contact modules 160. The contact modules 160 are held in a stacked configuration generally parallel to one another. The contact modules 160 hold a plurality of signal contacts (not shown) that are configured to be electrically connected to the signal contacts 142 of the first connector assembly 102 and the second circuit board 150. In an exemplary embodiment, the contact modules 160 provide electrical shielding for the signal contacts. The shielding structure of the second connector assembly 104 may be electrically commoned with the shielding structure of the first connector assembly 102.

In the illustrated embodiment, the first circuit board 130 is oriented generally vertically. The contact modules 140 of the first connector assembly 102 are orientated generally horizontally. The second circuit board 150 is oriented generally horizontally. The contact modules 160 of the second connector assembly 104 are oriented generally vertically. The first connector assembly 102 and the second connector assembly 104 have an orthogonal orientation with respect to one another.

In alternative embodiments, the first and/or second connector assemblies 102, 104 may be mounted to cables rather than the circuit boards 130, 150. In other alternative embodiments, the first and/or second connector assemblies 102, 104 may be in-line assemblies rather than right angle assemblies, where the signal contacts pass straight through the connector assemblies rather than being right angle contacts.

Figure 2:
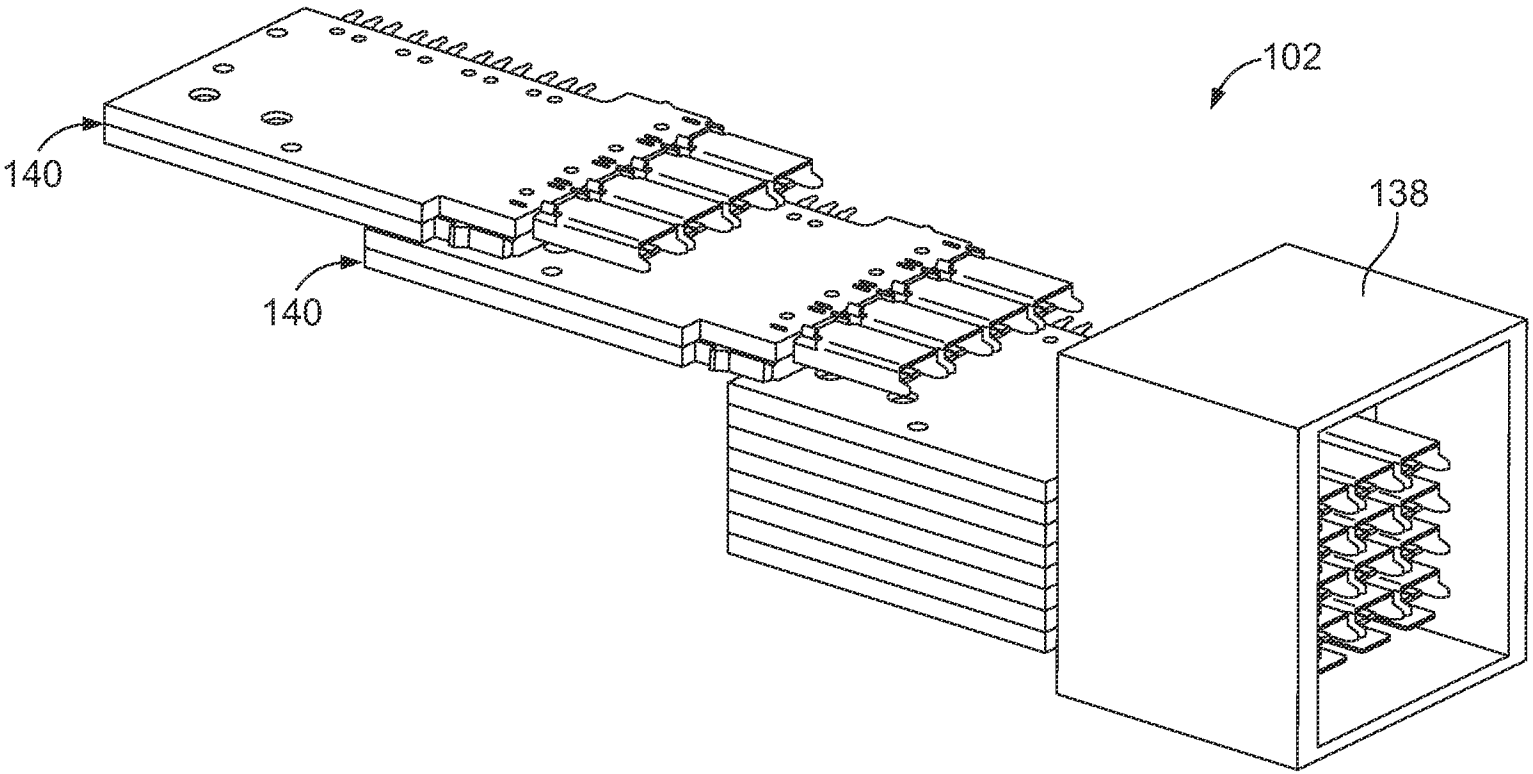
FIG. 2 is an exploded perspective view of a connector assembly of the electrical connector system formed in accordance with an exemplary embodiment

FIG. 2 is an exploded perspective view of the first connector assembly 102 formed in accordance with an exemplary embodiment showing some of the contact modules 140 poised for assembly and loading into the front housing 138. The front housing 138 is a dielectric housing. The front housing 138 holds the contact modules 140 in a stacked configuration. The contact modules 140 may be individually loaded into the front housing 138 or alternatively may be loaded in as a group. When loaded into the front housing 138, the shielding structures of the contact modules 140 are electrically connected together to electrically common each adjacent contact module 140.

Figure 3:
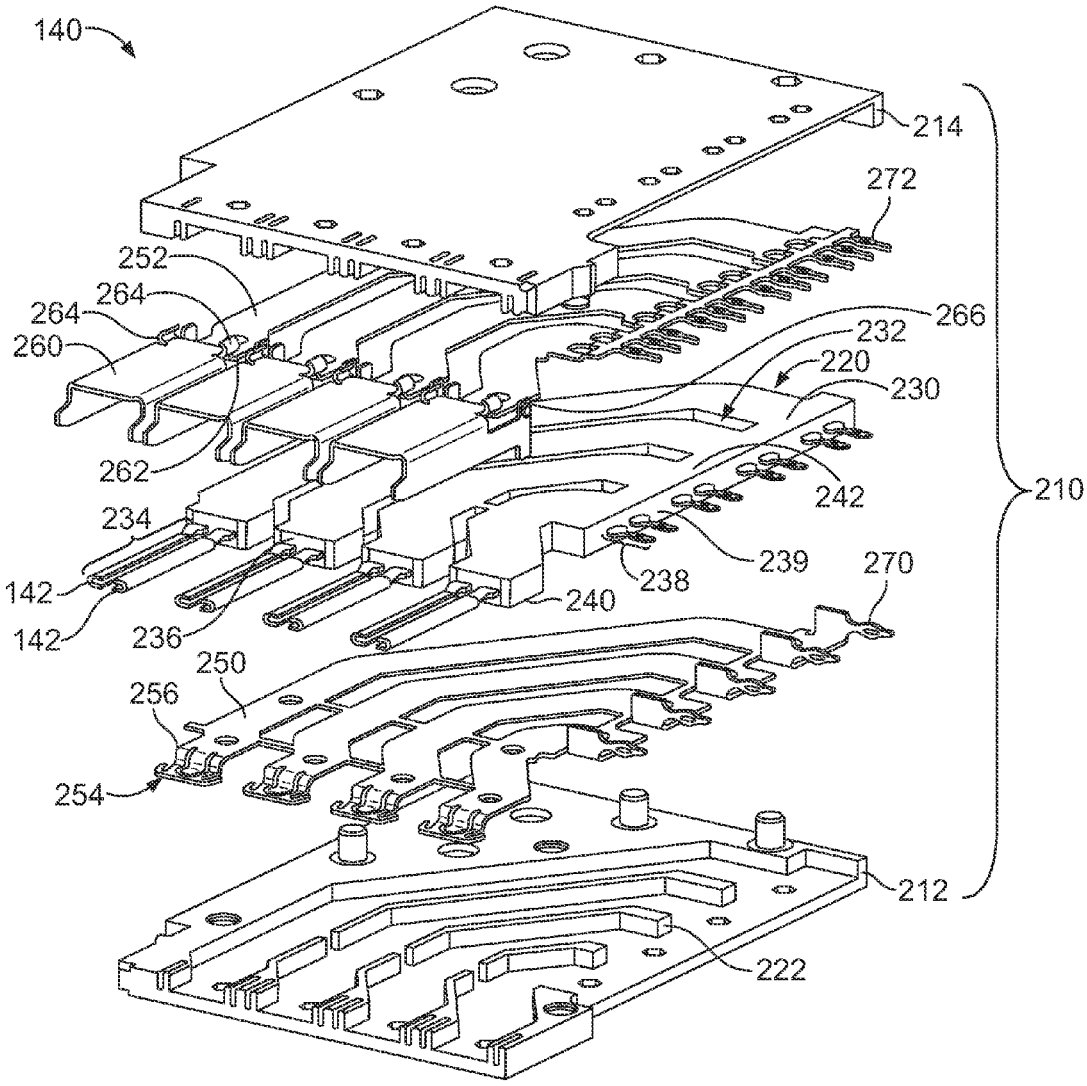
FIG. 3 is an exploded view of a contact modules of the connector assembly formed in accordance with an exemplary embodiment.

FIG. 3 is an exploded view of one of the contact modules 140 formed in accordance with an exemplary embodiment. The contact module 140 includes a conductive shell 210 that holds a wafer 220. In the illustrated embodiment, the shell 210 includes a first shell member 212 and a second shell member 214 that are coupled together to form the shell 210. The shell members 212, 214 are fabricated from a conductive material. For example, the shell members 212, 214 may be die cast from a metal material. Alternatively, the shell members 212, 214 may be stamped and formed or may be fabricated from a plastic material that has been metalized or coated with a metallic layer. By having the shell members 212, 214 fabricated from a conductive material, the shell members 212, 214 may provide electrical shielding for the signal contacts 142 of the first connector assembly 102. The shell members 212, 214 define at least a portion of a shielding structure of the first connector assembly 102. In alternative embodiments, the contact module 140 may not include the shell 210.

The wafer 220 includes a dielectric body 230 that holds the signal contacts 142. Optionally, the signal contacts 142 may be arranged in pairs configured to carry differential pair signals. The shell members 212, 214 provide shielding around the dielectric body 230, and thus around the signal contacts 142. In an exemplary embodiment, the shell members 212, 214 include tabs or ribs 222 (only shown on the shell member 212) that extend inward toward one another. The ribs 222 define at least a portion of a shielding structure that provides electrical shielding around the signal contacts 142. The ribs 222 are configured to extend into the dielectric body 230 such that the ribs 222 are positioned between corresponding signal contacts 142 to provide shielding between adjacent pairs of the signal contacts 142. In alternative embodiments, one shell member 212 or 214 could have tabs that accommodate the entire wafer 220 and the other shell member 212 or 214 acts as a lid.

In an exemplary embodiment, the signal contacts 142 are initially held together as leadframes (not shown), which are overmolded with dielectric material to form the dielectric body 230. Manufacturing processes other than overmolding a leadframe may be utilized to form the dielectric body 230, such as loading signal contacts 142 into a fowled dielectric body, applying dielectric material to a leadframe by a spray or dip method, applying a film or dielectric tape to contacts or a leadframe, and the like. The dielectric body 230 includes openings 232 that receive the ribs 222. The ribs 222 are positioned between pairs of the signal contacts 142 to provide shielding between such pairs of signal contacts 142.

The signal contacts 142 have mating portions 234 extending from a front 236 of the wafer 220. The signal contacts 142 have mounting portions 238 extending from the bottom 239 of the wafer 220. Other configurations are possible in alternative embodiments. The dielectric body 230 of the wafer 220 includes a first side 240 and a second side 242 opposite the first side 240. The signal contacts 142 extend through the dielectric body 230 along a contact plane generally parallel to the first and second sides 240, 242 between the front 236 and the bottom 239.

In an exemplary embodiment, the contact module 140 includes a first ground frame 250 and a second ground frame 252 that provide electrical shielding for the signal contacts 142. In an exemplary embodiment, the first and second ground frames 250, 252 are configured to be mechanically and electrically connected to ground frames of adjacent contact modules 140 to electrically connect the shielding structures of adjacent contact modules 140 together. The first and second ground frames 250, 252 are mechanically and electrically connected to other ground frames by a direct, physical engagement therebetween. For example, a portion of the first ground frame 250 physically touches a portion of the second ground frame 252 of the adjacent contact module 140, or vice versa.

The first and second ground frames 250, 252 are configured to be inlaid inside the shell 210. The first and second ground frames 250, 252 may be stamped and formed pieces set in the shell 210. The first ground frame 250 is positioned between the first side 240 of the dielectric body 230 and the first shell member 212 of the shell 210. The second ground frame 252 is positioned between the second side 242 of the dielectric body 230 and the second shell member 214 of the shell 210.

The first ground frame 250 includes a main body that is generally planar and extends alongside of the wafer 220. The first ground frame 250 includes beams 254 extending from a front 256 of the main body of the first ground frame 250. The beams 254 are configured to engage and be electrically connected to a second ground frame 252 of an adjacent contact module 140, as described in further detail below. The beams 254 electrically common the shielding structures of the adjacent contact modules 140 proximate the mating portions 234 of the signal contacts 142. Optionally, the beams 254 may be positioned directly between a corresponding pair of the signal contacts 142 and a pair of signal contacts 142 of an adjacent contact module 140.

The second ground frame 252 includes a main body that is generally planar and extends alongside of the wafer 220. The second ground frame 252 includes shields 260 extending from a front 262 of the main body of the second ground frame 252. The shields 260 provide shielding for the mating portions 234 of the signal contacts 142. In the illustrated embodiment, the shields 260 are C-shaped shields that are configured to surround pairs of the signal contacts 142 on three sides. The shields 260 may have other shapes in alternative embodiments. When the contact module 140 is positioned adjacent another contact module 140, the shields 260 of the other contact module 140 cover the fourth, open sides of the C-shaped shields 260 to provide electrical shielding on all four sides of the pairs of signal contacts 142.

In an exemplary embodiment, the second ground frame 252 includes tabs 264 that are configured to engage corresponding beams 254 of the first ground frame 250 of an adjacent contact module 140 to electrically connect the second ground frame 252 to the first ground frame 250 of the adjacent contact module 140.

In an exemplary embodiment, the second ground frame 252 includes shell grounding tabs 266 that are configured to engage the shell 210 to electrically connect the second ground frame 252 to the shell 210. Optionally, the shell grounding tabs 266 may include dimples or projections that engage the shell 210 by an interference fit. Optionally, the shell grounding tabs 266 may engage both the first and second shell members 212, 214. For example, dimples may be provided on both the upper and lower projections for engaging both shell members 212, 214.

The first ground frame 250 includes ground pins 270 configured to be mounted to the circuit board 130 (shown in FIG. 1). For example, the ground pins 270 may be compliant pins configured to be received in plated vias of the circuit board 130. The ground pins 270 may be positioned between, and provide electrical shielding between, pairs of the mounting portions 238 of the signal contacts 142. The second ground frame 252 includes ground pins 272 configured to be mounted to the circuit board 130. For example, the ground pins 272 may be compliant pins configured to be received in plated vias of the circuit board 130. The ground pins 272 extend along the mounting portions 238 to provide electrical shielding between the mounting portions 238 and mounting portions 238 of an adjacent contact module 140.

Figure 4:
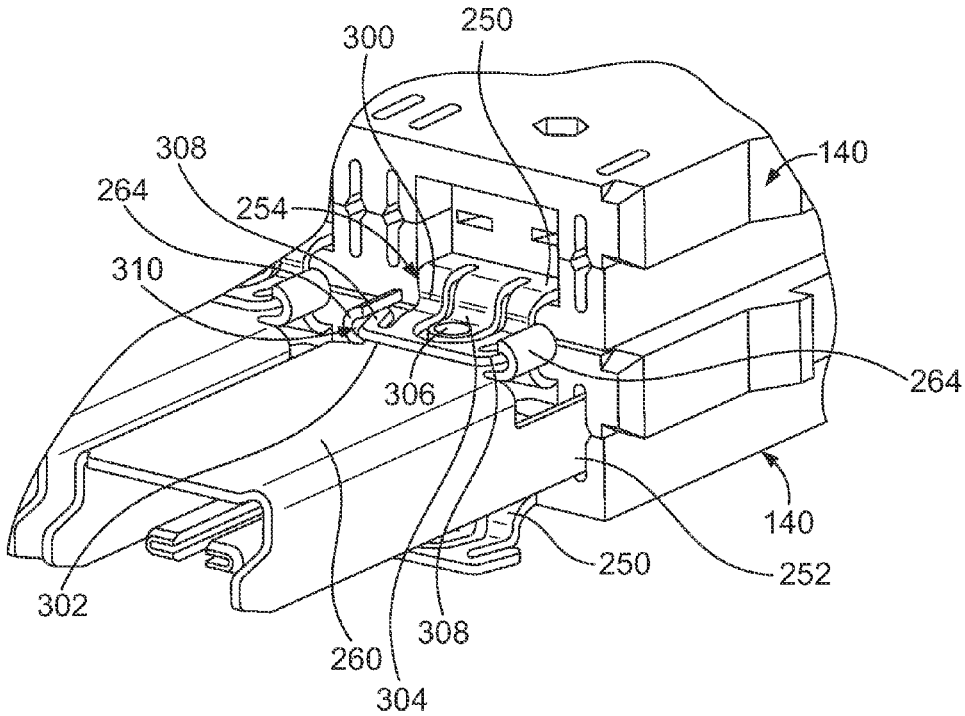
FIG. 4 is an enlarged view of a portion of the connector assembly showing an electrical grounding connection between two adjacent contact modules.

FIG. 4 is an enlarged view of a portion of the connector assembly 102 showing an electrical grounding connection between two adjacent contact modules 140. The front housing 138 (shown in FIG. 1) is removed for clarity. The second ground frame (not shown) and signal contacts (not shown) of the upper contact module 140 are removed for clarity to show the beam 254 of the first ground frame 250 of the upper contact module 140. The beam 254 is illustrated mated with the corresponding tab 264 of the second ground frame 252 of the lower contact module 140.

The beam 254 includes arms 300 extending from the main body of the first ground frame 250 to a tip 302 of the beam 254. The beam 254 includes a deflectable finger 304 resiliently engaged with the second ground frame 252 of the adjacent, lower contact module 140. In an exemplary embodiment, the finger 304 includes a protrusion 306 configured to engage the second ground frame 252. In the illustrated embodiment, the protrusion 306 is in the form of a dimple formed in the sheet metal of the finger 304; however other types of protrusions may be used in alternative embodiments. Optionally, the finger 304 may be approximately centered above the corresponding shield 260 of the second ground frame 252; however other locations are possible in alternative embodiments.

The beam 254 includes tines 308 extending from the sides of the beam 254. The tines 308 are deflectable and resiliently engaged with the corresponding tabs 264 of the second ground frame 252. The tines 308 define points of electrical contact between the first ground frame 250 and the second ground frame 252 of the adjacent contact module 140. The tines 308 may be used to center or locate the beam 254 relative to the shield 260. The tines 308 press against the tabs 264 to mechanically connect the first ground frame 250 to the second ground frame 252 of the adjacent contact module 140.

The tabs 264 extend upward from the top of the shield 260. In an exemplary embodiment, the tabs 264 are curled to form hooks defining a receptacle 310. The beam 254 is received in the receptacle 310. The tines 308 center the beam 254 in the receptacle 310. The tabs 264 pull the beam 254 toward the shield 260. The tabs 264 may be used to pull the adjacent contact modules 140 together to stabilize the contact modules 140 together. The tabs 264 may be used to press the finger 304 and/or the protrusion 306 against the shield 260 to create an additional point of electrical contact between the first and second ground frames 250, 252.

Figure 5:
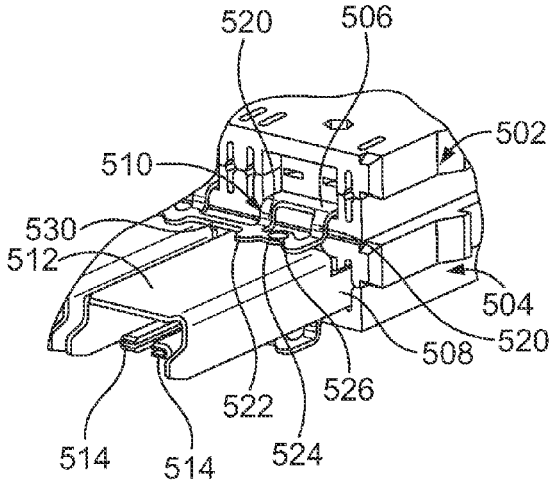
FIGS. 5-13 illustrate electrical grounding connections between two adjacent contact modules.

FIG. 5 illustrates another electrical grounding connection between two adjacent contact modules 502, 504. The upper and lower contact modules 502, 504 may be similar to the contact modules 140 (shown in FIG. 1); however the contact modules 502, 504 may have different structures for making the electrical grounding connection between two adjacent contact modules 502, 504. Optionally, the contact modules 502, 504 may be identical to one another; however portions of the upper contact module 502 are not shown in order to illustrate the electrical grounding connection between two adjacent contact modules 502, 504.

The contact modules 502, 504 each include a first ground frame 506 and a second ground frame 508 (the second ground frame of the upper contact module 502 is not shown). The first ground frame 506 includes beams 510 configured to engage the second ground frame 508 to electrically connect the shielding structure of the contact module 502 with the shielding structure of the contact module 504. The second ground frame 508 includes shields 512 providing electrical shielding around mating portions of signal contacts 514.

Each beam 510 includes arms 520 extending from the main body of the first ground frame 506 to a tip 522 of the beam 510. Optionally, the tip 522 may be angled or have a lead-in to prevent stubbing during assembly. The beam 510 includes a deflectable finger 524 between the arms 520 and resiliently engaged with the second ground frame 508 of the contact module 504. In an exemplary embodiment, the finger 524 includes a protrusion 526 configured to engage the second ground frame 508. In the illustrated embodiment, the protrusion 526 is in the form of a dimple. Optionally, the finger 524 may be approximately centered above the corresponding shield 512 of the second ground frame 508; however other locations are possible in alternative embodiments.

In an exemplary embodiment, the first ground frame 506 includes tie bars 530 extending between adjacent beams 510. The tie bars 530 electrically connect and common adjacent beams 510.

In the illustrated embodiment, the second ground frame 508 does not include any tabs, but rather the beams 510 are directly connected to the corresponding shields 512. In alternative embodiments, the second ground frame 508 may include tabs that directly engage the beams 510, such as to press the beams 510 against the second ground frame 508.

Figure 6:
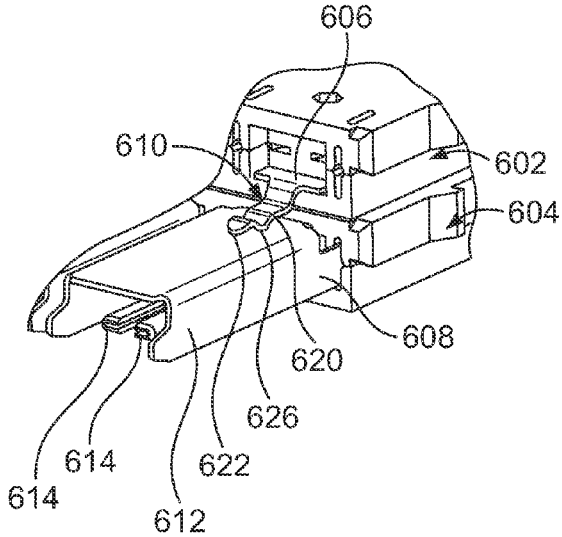

FIG. 6 illustrates another electrical grounding connection between two adjacent contact modules 602, 604. The upper and lower contact modules 602, 604 may be similar to the contact modules 140 (shown in FIG. 1); however the contact modules 602, 604 may have different structures for making the electrical grounding connection between two adjacent contact modules 602, 604. Optionally, the contact modules 602, 604 may be identical to one another; however portions of the upper contact module 602 are not shown in order to illustrate the electrical grounding connection between two adjacent contact modules 602, 604.

The contact modules 602, 604 each include a first ground frame 606 and a second ground frame 608 (the second ground frame of the upper contact module 602 is not shown). The first ground frame 606 includes beams 610 configured to engage the second ground frame 608 to electrically connect the shielding structure of the contact module 602 with the shielding structure of the contact module 604. The second ground frame 608 includes shields 612 providing electrical shielding around mating portions of signal contacts 614.

Each beam 610 includes a deflectable finger 620 extending from the main body of the first ground frame 606 to a tip 622 of the beam 610. The deflectable finger 620 is resiliently engaged with the second ground frame 608 of the contact module 604. In an exemplary embodiment, the finger 620 includes a protrusion 626 configured to engage the second ground frame 608. In the illustrated embodiment, the protrusion 626 is in the form of a trough extending downward toward the second ground frame 608. Optionally, the finger 620 may be approximately centered above the corresponding shield 612 of the second ground frame 608; however other locations are possible in alternative embodiments.

In the illustrated embodiment, the second ground frame 608 does not include any tabs, but rather the beams 610 are directly connected to the corresponding shields 612 and maintain electrical connections by spring forces against the second ground frame 608. In alternative embodiments, the second ground frame 608 may include tabs that directly engage the beams 610, such as to press the beams 610 against the second ground frame 608.

Figure 7:
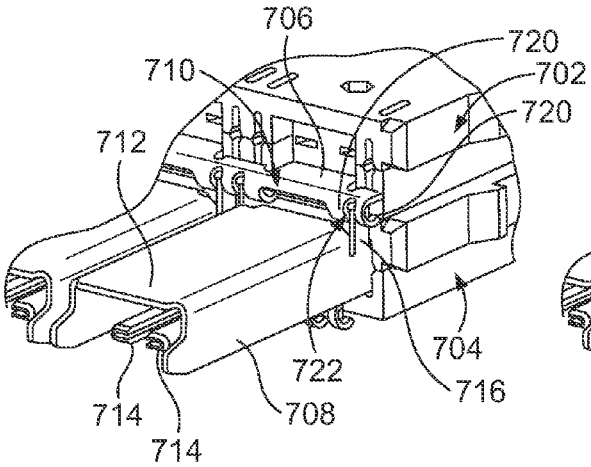

FIG. 7 illustrates another electrical grounding connection between two adjacent contact modules 702, 704. The upper and lower contact modules 702, 704 may be similar to the contact modules 140 (shown in FIG. 1); however the contact modules 702, 704 may have different structures for making the electrical grounding connection between two adjacent contact modules 702, 704. Optionally, the contact modules 702, 704 may be identical to one another; however portions of the upper contact module 702 are not shown in order to illustrate the electrical grounding connection between two adjacent contact modules 702, 704.

The contact modules 702, 704 each include a first ground frame 706 and a second ground frame 708 (the second ground frame of the upper contact module 702 is not shown). The first ground frame 706 includes beams 710 configured to engage the second ground frame 708 to electrically connect the shielding structure of the contact module 702 with the shielding structure of the contact module 704.

The second ground frame 708 includes shields 712 providing electrical shielding around mating portions of signal contacts 714. The second ground frame 708 includes tabs 716 extending outward therefrom. In the illustrated embodiment, the tabs 716 are provided on both sides of each shield 712. The tabs 716 extend vertically upward. Other configurations of the tabs 716 are possible in alternative embodiments.

Each beam 710 includes arms 720 extending from the main body of the first ground frame 706. The arms 720 are curled under the beam 710 toward the corresponding shell. Slots 722 are formed between pairs of the arms 720. The slots 722 receive corresponding tabs 716. Optionally, the aims 722 may include protrusions extending into the slots 722 to engage the tabs 716. Optionally, each of the beams 710 may be tied together by tie bars to mechanically and electrically connect the beams 710.

Figure 8:
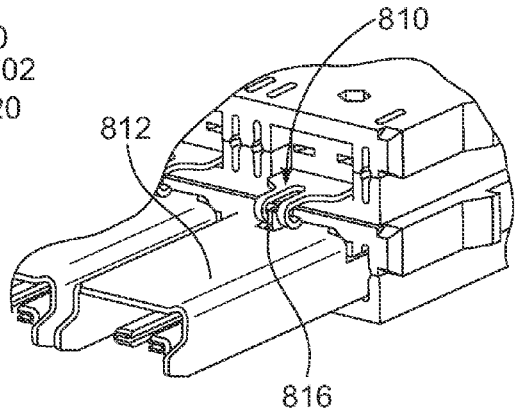

FIG. 8 illustrates another electrical grounding connection similar to the configuration shown in FIG. 7; however the electrical grounding connection shown in FIG. 8 includes beams 810 and tabs 816 that are centered above corresponding shields 812 as opposed to being along both sides of the shields 812.

Figure 9:
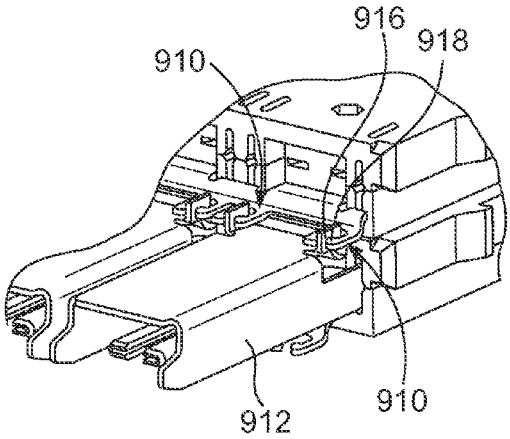

FIG. 9 illustrates another electrical grounding connection similar to the configuration shown in FIG. 7; however the electrical grounding connection shown in FIG. 9 includes beams 910 having a tuning fork type of connection to corresponding tabs 916 extending from corresponding shields 912. The beams 910 are not folded back under, but rather extend forward for connection with the tabs 916. Protrusions 918 of the beams 910 engage the tabs 916. Optionally, each of the beams 910 may be tied together by tie bars to mechanically and electrically connect the beams 910.

Figure 10:
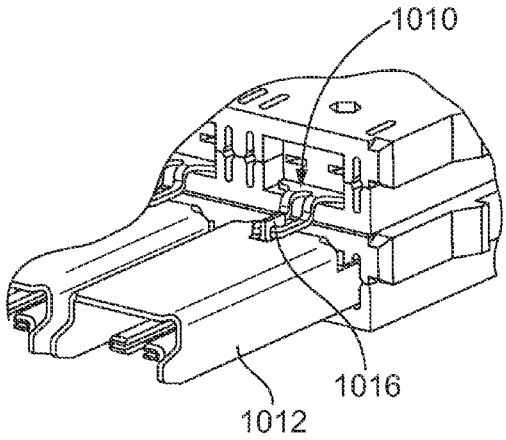

FIG. 10 illustrates another electrical grounding connection similar to the configuration shown in FIG. 9; however the electrical grounding connection shown in FIG. 10 includes beams 1010 and tabs 1016 that are centered above corresponding shields 1012 as opposed to being along both sides of the shields 1012.

Figure 11:
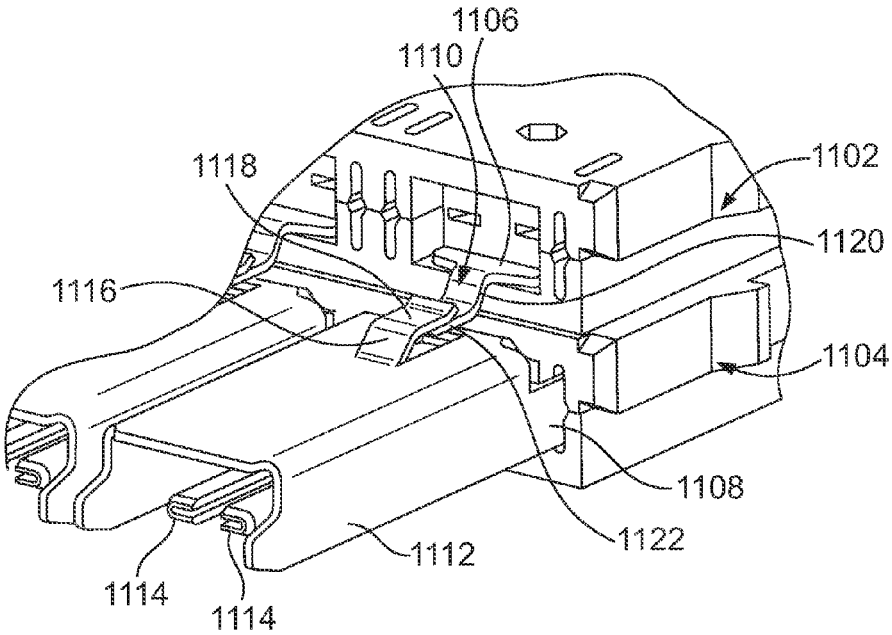

FIG. 11 illustrates another electrical grounding connection between two adjacent contact modules 1102, 1104. The upper and lower contact modules 1102, 1104 may be similar to the contact modules 140 (shown in FIG. 1); however the contact modules 1102, 1104 may have different structures for making the electrical grounding connection between two adjacent contact modules 1102, 1104. Optionally, the contact modules 1102, 1104 may be identical to one another; however portions of the upper contact module 1102 are not shown in order to illustrate the electrical grounding connection between two adjacent contact modules 1102, 1104.

The contact modules 1102, 1104 each include a first ground frame 1106 and a second ground frame 1108 (the second ground frame of the upper contact module 1102 is not shown). The first ground frame 1106 includes beams 1110 configured to engage the second ground frame 1108 to electrically connect the shielding structure of the contact module 1102 with the shielding structure of the contact module 1104.

The second ground frame 1108 includes shields 1112 providing electrical shielding around mating portions of signal contacts 1114. The second ground frame 1108 includes tabs 1116 extending outward from the shields 1112. Optionally, the tabs 1116 may be approximately centered along the shields 1112. The tabs 1116 extend upward and rearward and include a mating segment 1118. Other configurations of the tabs 1116 are possible in alternative embodiments.

Each beam 1110 includes an arm 1120 extending from the main body of the first ground frame 1106. The beam 1110 includes a deflectable finger 1122 extending from the arm 1120. The deflectable finger 1122 is configured to be received under the corresponding tab 1116. The deflectable finger 1122 engages the mating segment 1118. The deflectable finger 1122 may be resiliently engaged with the tab 1116 to ensure a mechanical and electrical connection between the first and second ground frames 1106, 1108. Optionally, the tab 1116 may be resiliently engaged with the finger 1122 and/or the arm 1120. The tab 1116 pulls the contact module 1102 against the contact module 1104.

Figure 12:
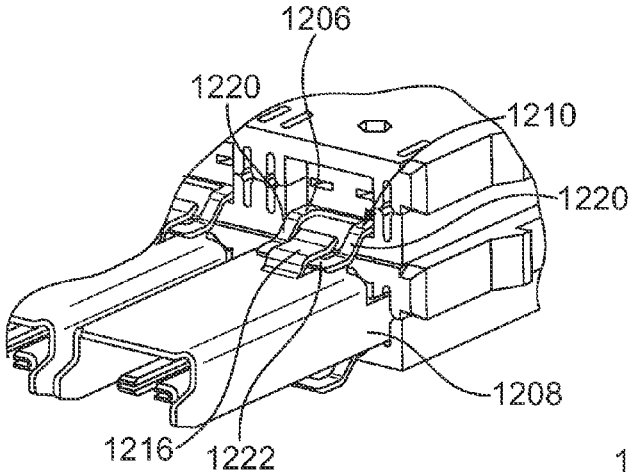

FIG. 12 illustrates another electrical grounding connection similar to the configuration shown in FIG. 11; however the electrical grounding connection shown in FIG. 12 includes a first ground frame 1206 having a beam 1210 with a pair of arms 1220 and a finger 1222 extending therebetween. The finger 1222 is captured beneath a tab 1216 of a second ground frame 1208.

Figure 13:
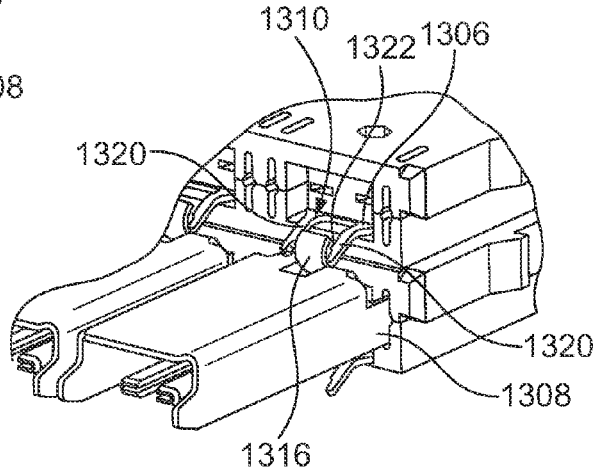

FIG. 13 illustrates another electrical grounding connection similar to the configuration shown in FIG. 12; however the electrical grounding connection shown in FIG. 13 includes a tab 1316 of a second ground frame 1308 that is curled backward to capture a beam 1310 of a first ground frame 1306. The beam 1310 has a pair of arms 1320 and a finger 1322 extending therebetween. The finger 1322 is captured beneath the tab 1316.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first" "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a front housing; and a plurality of contact modules held by the front housing, each contact module comprising:

a wafer having a dielectric body holding a plurality of signal contacts, the dielectric body having a first side and a second side, the signal contacts having mating portions extending forward from a front of the dielectric body;

a first ground frame extending along the first side of the dielectric body, the first ground frame providing electrical shielding for the signal contacts, the first ground frame having beams extending from a front of the first ground frame; and a second ground frame extending along the second side of the dielectric body, the second ground frame providing electrical shielding for the signal contacts, the second ground frame having shields at least partially surrounding corresponding mating portions of the signal contacts;

wherein each first ground frame is mechanically and electrically connected to an adjacent second ground frame of an adjacent contact module and wherein each second ground frame is mechanically and electrically connected to an adjacent first ground frame of an adjacent contact module; and wherein the plurality of contact modules comprises a first contact module, a second contact module and a third contact module arranged in a stacked configuration adjacent one another in the front housing, the beams of the first ground frame of the second contact module engaging the second ground frame of the first contact module, and wherein the second ground frame of the second contact module engages the beams of the first ground frame of the third contact module.

2. The connector assembly of claim 1, wherein the beams of the first ground frames electrically common adjacent contact modules.

3. The connector assembly of claim 1, wherein the signal contacts are arranged in pairs carrying differential pair signals, the shields at least partially surrounding the mating portions of corresponding pairs of the signal contacts, the beams being positioned between the pairs of the signal contacts and pairs of signal contacts of adjacent contact modules.

4. The connector assembly of claim 1, wherein the beams include protrusions engaging the second ground frames of adjacent contact modules.

5. The connector of assembly of claim 1, wherein the beams include deflectable fingers resiliently engaged with the second ground frames of adjacent contact modules.

6. The connector of assembly of claim 1, wherein the first ground frames include tie bars connecting adjacent beams.

7. The connector assembly of claim 1, wherein each contact module further comprises a shell holding the wafer, the first ground frame being positioned between the first side and the shell, the second ground frame being positioned between the second side and the shell.

8. The connector assembly of claim 7, wherein the shell is conductive and provides electrical shielding for the signal contacts, the first ground frame and second ground frame being mechanically and electrically connected to the shell.

9. The connector assembly of claim 1, wherein the second ground frame includes tabs extending therefrom, the beams being mechanically and electrically connected to corresponding tabs.

10. The connector assembly of claim 9, wherein the tabs are resiliently engaged with the beams to hold adjacent contact modules together.

11. The connector assembly of claim 9, wherein the beams include arms extending from the front of the first ground frame with slots defined between the arms, the slots receiving the tabs, the arms engaging the tabs to mechanically and electrically connect the first ground frame with the adjacent second ground frame.

12. A contact module for a connector assembly, the contact module defining a middle contact module configured to be arranged between a right contact module and a left contact module, the contact module comprising:

a wafer having a dielectric body holding a plurality of signal contacts, the dielectric body having a first side and a second side, the signal contacts having mating portions extending forward from a front of the dielectric body;

an first ground frame extending along the first side of the dielectric body, the first ground frame providing electrical shielding for the signal contacts, the first ground frame having beams extending from a front of the first ground frame; and an second ground frame extending along the second side of the dielectric body, the second ground frame providing electrical shielding for the signal contacts, the second ground frame having shields at least partially surrounding corresponding mating portions of the signal contacts;

wherein the beams of the first ground frame of the middle contact module are configured to directly engage a second ground frame of the right contact module, and wherein the second ground frame of the middle contact module is configured to directly engage a beam of a first ground frame of the left contact module.

13. The contact module of claim 11, further comprising a shell holding the wafer, the first ground frame being positioned between the first side and the shell, the second ground frame being positioned between the second side and the shell.

14. The connector assembly of claim 12, wherein the beams include protrusions configured to engage the second ground frame of the adjacent contact module.

15. The connector of assembly of claim 12, wherein the beams include deflectable fingers resiliently engaged with the second ground frame of the adjacent contact module.

16. The contact module of claim 12, wherein the second ground frame includes tabs extending therefrom, the tabs being configured to be mechanically and electrically connected to corresponding beams of the adjacent contact module.

17. The contact module of claim 16, wherein the tabs are resiliently engaged with the beams of the adjacent contact module.

18. The contact module of claim 16, wherein the beams include arms extending from the front of the first ground frame with slots defined between the arms, the slots being configured to receive tabs of an adjacent contact module, the arms being configured to engaging the corresponding tabs of the adjacent contact module to mechanically and electrically connect the first ground frame with the second ground frame of the adjacent contact module.

19. A connector assembly comprising:

a front housing; and a first contact module held by the front housing, the first contact module comprising a wafer holding a plurality of signal contacts, an first ground frame extending along a first side of the wafer and providing electrical shielding for the signal contacts, and an second ground frame extending along a second side of the wafer and providing electrical shielding for the signal contacts, the second ground frame having shields at least partially surrounding corresponding the signal contacts, the second ground frame having tabs extending therefrom, the first ground frame having beams extending from a front of the first ground frame; and a second contact module held by the front housing adjacent the first contact module, the second contact module comprising a wafer holding a plurality of signal contacts, an first ground frame extending along a first side of the wafer and providing electrical shielding for the signal contacts, and an second ground frame extending along a second side of the wafer and providing electrical shielding for the signal contacts, the second ground frame having shields at least partially surrounding corresponding signal contacts, the second ground frame having tabs extending therefrom, the first ground frame having beams extending from a front of the first ground frame;

wherein the beams of the first ground frame of the first contact module directly engage corresponding tabs of the second ground frame of the second contact module, the tabs providing a holding force to pull the first contact module toward the second contact module, the first ground frame of the first contact module being electrically commoned with the second ground frame of the second contact module.

* * * * *